United States Patent [19]

Pipik

[11] Patent Number: 4,799,681

[45] Date of Patent: Jan. 24, 1989

[54] BASEBALL RUNNER PADS

[76] Inventor: Albert M. Pipik, Box 203, Main St., Allenport, Pa. 15412

[21] Appl. No.: 904,985

[22] Filed: Sep. 8, 1986

[51] Int. Cl.[4] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 2,084,775 | 6/1937 | Orefice | 273/25 |
| 2,122,266 | 6/1938 | Seys | 273/25 |
| 2,156,469 | 5/1939 | Boltz | 273/25 |
| 2,189,428 | 2/1940 | Love | 273/25 |
| 2,400,042 | 4/1948 | Friedman | 273/25 |
| 3,181,863 | 5/1985 | Nellermore | 273/25 |
| 3,466,039 | 9/1969 | Golomb | 273/25 |
| 3,862,756 | 1/1975 | Selliken | 273/25 |
| 3,938,804 | 2/1976 | Willett | 273/25 |
| 4,306,718 | 12/1981 | Goedes | 273/25 |
| 4,493,486 | 1/1985 | Fuller et al. | 273/25 |

OTHER PUBLICATIONS

Sporting News, Sep. 5, 1970, vol. 170, No. 3.

*Primary Examiner*—Richard C. Pinkham
*Assistant Examiner*—T. Brown
*Attorney, Agent, or Firm*—Webb, Burden, Ziesenheim & Webb

[57] ABSTRACT

An auxiliary safety base pad is provided, particularly for the first base position, adapted to be fastened alongside the conventional base pad and extend across the running lane adjacent first base. The pad is preferably made up of a hard rubber base member with a covering of outdoor type carpet. The covering is attached to the base except for the corners thereof. A grommet is placed at each corner of the hard rubber for receiving a spike fastener upon anchoring the base to the playing field. After the base is anchored the corners of the covering are placed over the spikes and grommets in a concealing fashion.

5 Claims, 1 Drawing Sheet

BASEBALL RUNNER PADS

This invention relates to baseball runner pads and particularly to a auxiliary safety base pad particularly for the first base portion of softball and baseball fields. Baseball and softball fields have dimensions which have been set and have remained unchanged for many years. Conventionally, the bases used in the game of softball or baseball are typically 15 inches square and 3 to 5 inches thick and are padded and made of suitable material to withstand the rough useage and the spikes of baseball players. The first base pad is disposed wholly within the infield of either the baseball or softball field. Eventually a runner's lane is provided alongside the first base line on the outside of the line from the infield so that the runner can run along the infield line to first base without being in the infield and without the danger of collison with a player within the infield. However, as he approaches first base he must tag the base as he passes it. This means that he must move over into the infield or at least his foot must come down within the infield on the first base side. As a result, the runner usually turns infield immediately before reaching first base in order to be sure to tag or touch the base. On the other hand, the fielder or other player may be either standing on the base and attempting to catch a ball thrown at great speed toward the base to get the runner out or the fielder will also be running at full speed toward first base in order to beat the runner there and thus get the runner out. As a result, a very dangerous situation exists in which the possibility of collision between runner and fielder is very great. The problem is particularly acute in amateur sports where relatively unskilled young people are playing and encouraged to play the game of baseball or the game of softball The result is that there are all too frequently collisions at first base which result in injury to one or both of the runner and the fielder.

The problem of collisions at first base is a recognized problem and there have been proposals for safety bases to attempt to avoid this problem. In general, the proposals which have been made in an attempt to overcome this problem have simply involved enlarging the base pad itself in one direction so that a small portion of the pad extends over the base line along the infield into the runner's lane. Typical of these proposals is that set out in Willett U.S. Pat. No. 3,938,804. There the inventor proposes a bag which has one portion of one color which is within the infield and which is generally exclusively for the fielder. A very small portion, about the width of a foot, is placed outside the base line in the runner's lane and an intermediate portion connects the two. All of them have different colors so that the device has a three color configuration. The problem with this device is that it is really very little better than the conventional base bag because so little of it extends into the runner's lane that the temptation for the runner is to run into the main body of the bag thus thwarting the whole purpose of the invention.

A second proposal to solve this problem appears in the Fuller et al. U.S. Pat. Nos. 4,398,714 and 4,493,486 both of which show a device similar to that of Willett with an elongated base pad of two different colors, one portion designed to lie within the base line to be used by the fielder and the other portion projecting in part beyond the base line where it may be tagged by the runner. Here again the problem is that the portion which extends into the runner's lane is smaller than the portion which is used by the fielder and the result is again the temptation for the runner to hit the center of the bag either on the foul line or adjacent the foul line or base line which in effect will result in the same problem of collision.

THE INVENTION

The present invention provides an auxiliary safety base pad particularly for the first base position of softball and baseball fields which comprises a generally rectangular safety base pad member adapted to be fastened alongside the conventional base pad and to extend across the running lane adjacent first base whereby the runner can tag the rectangular safety base pad member instead of the conventional base and thereby reduce the danger of collision between the runner and the player covering first base and a concealed fastener means at each corner of the safety base pad adapted to engage the safety base pad and hold it fixed in place. Preferably the safety base pad extends completely across the width of the runner's lane and is of a width the same as that of the base itself. This eliminates the temptation for the runner to cross over the base line onto the body of the base itself since there is no restriction on a narrow part of the base pad which he must touch since he can touch any part of the auxiliary safety base pad. Accordingly, the safety base pad is preferably about 15 inches by 36 inches in outside dimensions. However, it may be reduced in length so as to not fully extend across the runner's lane and thus be only about 20 inches in length. The safety base pad of this invention is preferably made up of a hard rubber base and a top cover of outdoor carpeting. The hard rubber base preferably has metal grommets fixed therein at each corner receiving a hold down spike and the top cover is loose at each corner sufficient to be turned back to permit access to each grommet for inserting the spikes. The hard rubber pad is preferably beveled along the edge facing the oncoming runner at an angle of about 45°.

In the foregoing general description I have set out certain objects and purposes of this invention however other objects and purposes of the invention will become apparent from a consideration of the following description and the accompanying drawings.

DESCRIPTION OF THE INVENTION

Figure 1:
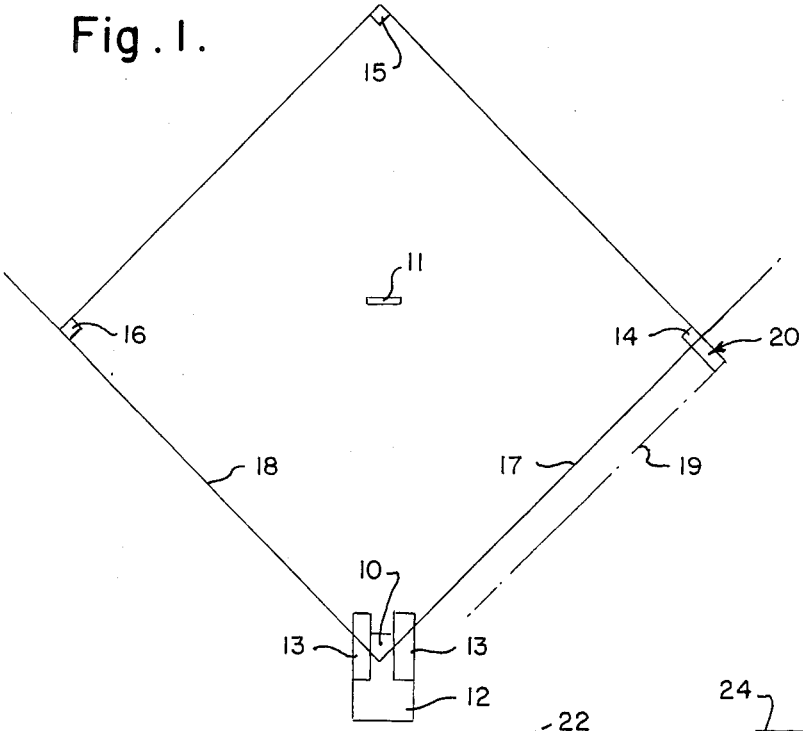
FIG. 1 is a top plan view of a softball diamond which is similar to a baseball diamond excepting for the dimensions.
Figure 5:
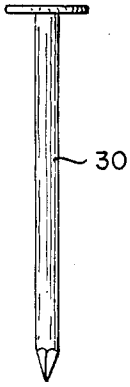
FIG. 5 is a side elevational view of the hold down spike for use with the safety base pad of the invention.
Figure 2:
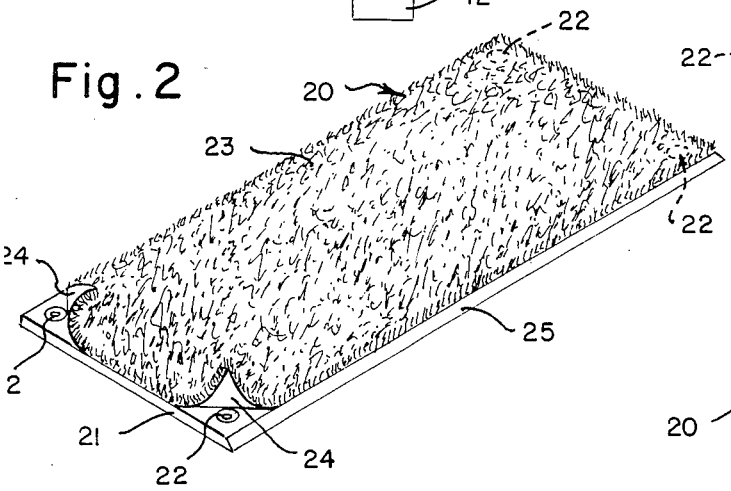
FIG. 2 is an isometric view of a safety base pad according to the invention with one corner of the top cover turned back to show the spike grommet in the hard rubber base.
Figure 3:
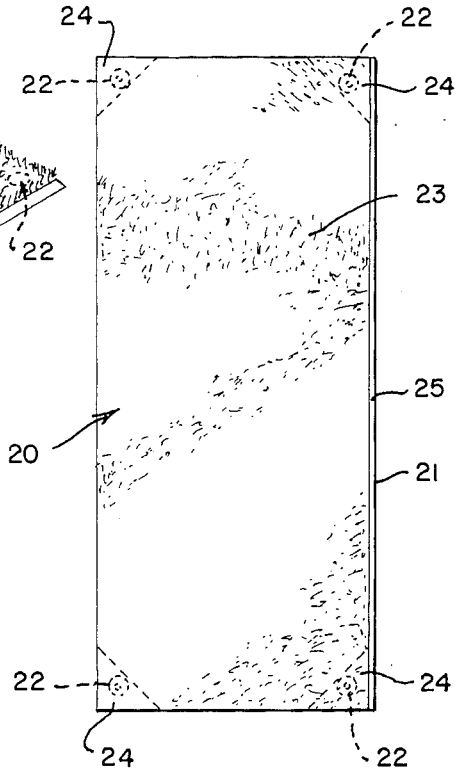
FIG. 3 is a top plan view of the safety base pad of the invention.
Figure 4:
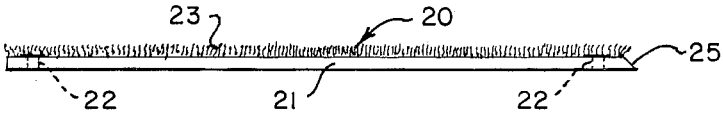
FIG. 4 is a side elevation of the safety base pad of this invention.

Referring to the drawings, I have illustrated a softball field having a home plate 10, a pitcher's mound and plate 11, a catcher's box 12, batter's box 13, first base 14, second base 15, third base 16 with the first base foul line 17 and the third base foul line 18 and a first base runner's line 19 as conventionally used.

The safety base pad of this invention 20 is placed between the first base 14 and the runner's lane line 19 so that it is completely outside the first base foul line 17. Thus there is no incentive for the runner to cross over the foul line 17 into first base 14 and thus to the possible inducement of an accident.

The safety base pad of this invention is made up of a hard rubber base 21 which is preferably about one-half inch thick and has molded into it at each corner metal grommets 22 which are adapted to take a hold down spike. A layer of outdoor carpet 23 is fixed to the hard rubber bottom layer 21 excepting at the corners where a hold down flap 24 is provided which may be folded back to permit access to the grommets 22 so that the spikes may be inserted for fastening the safety base pad of the invention in place.

The edge of the hard rubber pad 21 which faces home plate and thus the advancing runner is beveled at an angle of 45°. This beveled face is identified by the numeral 25 in the drawings and is provided to reduce the chance of the safety base pad tripping a runner or being scuffed loose by a runner.

In use, the pad is fastened in place between the first base foul line 17 and the runner's outside limiting line 19. It is held in place by the insertion of spikes through the grommets 22 so that it, in effect, provides an extension of the base pad 14 outwardly to the runner's lane line 19. Accordingly, when a runner is approaching first base it is at no time necessary for him to cross the first base foul line 17 to tag the base 14. Thus, the reason for accidential collisions between the runner and the fielder approaching first base simultaneously or at first base simultaneously are eliminated. As a result, the spiking of the fielder at first base is eliminated as well as the collisions which have been of all too frequent occurrence particularly in amateur baseball and softball.

In the foregoing specification, I have set out certain preferred practices and embodiments of this invention however it will be understood that the invention may be otherwise embodied within the scope of the following claims.

I claim:

1. An auxiliary safety base pad particularly for the first base position of soft ball and baseball fields comprising a generally rectangular safety base pad member adapted to be fastened alongside the conventional base pad and extend across the running lane and adjacent first base whereby the runner can tag the rectangular safety base pad member instead of the conventional base and thereby reduce the danger of collision between the runner and the player covering first base, a concealed fastener means at each corner of the safety base pad adapted to engage the safety base pad and hold it fixed in place, said fastener means having at least one spike, said safety base pad having a base of hard rubber and a top cover of outdoor carpeting, said hard rubber base having metal grommet fixed therein at each corner to receive said spike, said top cover being loose at each corner sufficient to permit access to each grommet for inserting said spike and for concealing said spike.

2. A safety base pad as claimed in claim 1 wherein one edge of the hard rubber pad which is intended to face the oncoming runner is beveled.

3. A safety base pad as claimed in claim 2 wherein the bevel is 45°.

4. A safety base pad as claimed in claim 1, wherein the safety base pad is about 15" by about 36" in outside dimensions.

5. A safety base pad as claimed in claim 1, wherein the safety base pad is about 15" by about 20" in outside dimensions.

* * * * *